US008113617B2

(12) United States Patent
Ito

(10) Patent No.: US 8,113,617 B2
(45) Date of Patent: Feb. 14, 2012

(54) INK-JET RECORDING APPARATUS FOR CURRENT DETECTION DURING STARTUP AND TERMINATION

(75) Inventor: Koji Ito, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 617 days.

(21) Appl. No.: 12/212,335

(22) Filed: Sep. 17, 2008

(65) Prior Publication Data

US 2009/0085945 A1 Apr. 2, 2009

(30) Foreign Application Priority Data

Sep. 28, 2007 (JP) ..... 2007-256198

(51) Int. Cl.
*B41J 29/393* (2006.01)
*B41J 29/38* (2006.01)
*B41J 2/45* (2006.01)

(52) U.S. Cl. ..... 347/19; 347/9; 347/68

(58) Field of Classification Search ..... 347/19
See application file for complete search history.

(56) References Cited

U.S. PATENT DOCUMENTS

2004/0041876 A1* 3/2004 Uchida et al. ..... 347/29
2007/0211090 A1* 9/2007 Hibi et al. ..... 347/9

FOREIGN PATENT DOCUMENTS

JP 63280651 A * 11/1988
JP 2002036568 A 2/2002
JP 2002127405 A 5/2002

* cited by examiner

*Primary Examiner* — Shelby Fidler
(74) *Attorney, Agent, or Firm* — Baker Botts L.L.P.

(57) ABSTRACT

An ink-jet recording apparatus, including: a flow-passage unit; a plurality of actuators; a plurality of signal output circuits which are provided so as to respectively correspond to the actuators; at least one power supply device; at least one electric current detecting device; and a control device including (a) a startup charging portion which controls the signal output circuits, upon startup of the apparatus, such that all of the actuators are placed into a charged state from a discharged state in order at least one by one, when all of the actuators are in the discharged state and (b) a power-supply inhibiting portion which inhibits electric power supply from the at least one power supply device when the electric current detected by any of the at least one electric current detecting device is equal to or larger than a threshold during execution of a control by the startup charging portion.

11 Claims, 10 Drawing Sheets

INK-JET RECORDING APPARATUS FOR CURRENT DETECTION DURING STARTUP AND TERMINATION

CROSS REFERENCE TO RELATED APPLICATION

The present application claims priority from Japanese Patent Application No. 2007-256198, which was filed on Sep. 28, 2007, the disclosure of which is herein incorporated by reference to its entirety.

BACKGROUND OF THE INVENTION

1. Field of the Invention

The present invention relates in general to an ink-jet recording apparatus which performs recording or printing by ejecting ink droplets.

2. Discussion of Related Art

An ink-jet head of an ink-jet printer for ejecting ink droplets onto a recording medium such as a recording sheet includes: a flow-passage unit in which are formed nozzles through which ink droplets are ejected and pressure chambers which communicate with the nozzles; actuators which apply an ejection energy to ink in the pressure chambers; and a driver IC in which are incorporated signal output circuits which output drive signals for driving the actuators. As the actuators each configured to apply a pressure to the ink in the pressure chambers by changing the volume thereof, there is known one disclosed in Patent Document 1 including: a piezoelectric sheet (piezoelectric layer) extending over a plurality of pressure chambers; a plurality of individual electrodes facing respectively the plurality of pressure chambers; and a common electrode (ground electrode) which faces the plurality of individual electrodes via the piezoelectric sheet and to which a base potential is given. In the disclosed actuators, when a drive pulse signal outputted from the signal output circuit of the driver IC is inputted to one of the individual electrodes, an electric field is generated at a portion of the piezoelectric sheet interposed between the above-indicated one individual electrode and the common electrode in a thickness direction of the piezoelectric sheet, so that the piezoelectric sheet at that portion expands or elongates in the thickness direction. Accordingly, the volume of the pressure chamber that corresponds to the one individual electrode is changed, whereby the pressure (ejection energy) is given to the ink in that pressure chamber.

In the ink-jet printer, there may be a risk that a short circuit occurs in the driver IC or the actuators due to breakage thereof, causing an overcurrent to flow in the signal output circuits. In particular when the ink-jet printer is in a non-operating state or in a standby state, the short circuit occurs at high frequency due to occurrence of migration phenomenon and entry of the ink from the pressure chambers into the corresponding actuators. When the ink-jet printer is turned on with the short circuit occurring, the overcurrent flows in the signal output circuits. To monitor the overcurrent, an electric current detecting circuit may be provided for detecting an electric current from the power supply device. However, since a maximum value of the electric current consumed when all of the actuators of the printer are placed in a charged state upon startup of the printer is high, it is difficult to detect the overcurrent when the overcurrent flows only in the signal output circuits corresponding to a part of the actuators. In view of this, there has been disclosed, in Patent Document 2, for instance, a technique of monitoring the electric current in each signal output circuit by disposing the electric current detecting circuit for each of the signal output circuits corresponding to the actuators.

Patent Document 1 JP 2002-36568 (FIG. 1)

Patent Document 2 JP 2002-127405 (FIG. 1)

SUMMARY OF THE INVENTION

Where the electric current detecting circuit is disposed for each of the signal output circuits that correspond to the actuators as disclosed in the above-indicated Patent Document 2, the cost of manufacture of the ink-jet printer inevitably increases and the control circuit for the actuators tends to be large-sized. Further, when all of the actuators are simultaneously placed in the charged state upon startup of the ink-jet printer, all of the actuators are simultaneously displaced, thereby causing the ink to leak through the nozzles. In this instance, a large inrush current flows, whereby electromagnetic noise is generated and a heavy load is applied to the power supply device, resulting in misoperation of a protective circuit.

It is therefore an object of the present invention to provide an ink-jet recording apparatus which is capable of reducing a load to be imposed on a power supply device and inhibiting unnecessary behavior of actuators while inspecting the actuators and signal output circuits for a short circuit, upon startup of the apparatus, and which ensures a reduction in its size and a reduction in its manufacturing cost.

The above-indicated object may be attained according to a principle of the invention, which provides an ink-jet recording apparatus, comprising:

a flow-passage unit including a plurality of pressure chambers, a plurality of nozzles provided so as to respectively correspond to the plurality of pressure chambers, and a plurality of individual ink passages through which the plurality of pressure chambers respectively communicate with the plurality of nozzles;

a plurality of actuators including a plurality of individual electrodes provided so as to respectively correspond to the plurality of pressure chambers, a ground electrode which is disposed so as to face to the plurality of individual electrodes and to which is given a base potential, and a piezoelectric layer interposed between the plurality of individual electrodes and the ground electrode;

a plurality of signal output circuits which are provided so as to respectively correspond to the plurality of actuators and each of which outputs a signal for giving a drive potential to a corresponding one of the plurality of individual electrodes for placing a corresponding one of the plurality of actuators into a charged state and each of which outputs a signal for giving the base potential to the corresponding one of the plurality of individual electrodes for placing the corresponding one of the plurality of actuators into a discharged state;

at least one power supply device which supplies, to the plurality of signal output circuits, an electric power for giving the drive potential to the plurality of individual electrodes;

at least one electric current detecting device which detects an electric current with respect to the electric power supplied by the at least one power supply device; and a control device including (a) a startup charging portion which controls the plurality of signal output circuits, upon startup of the ink-jet recording apparatus, such that all of the plurality of actuators are placed into the charged state from the discharged state in order at least one by one, when all of the plurality of actuators are in the discharged state and (b) a power-supply inhibiting portion which inhibits the electric power from being supplied from the at least one power supply device when the electric current detected by any of the at least one electric current detecting device is equal to or larger than a threshold during execution of a control by the startup charging portion.

In the ink-jet recording apparatus constructed as described above, the actuators are placed into the charged state from the discharged state at least one by one, upon startup of the apparatus, when the actuators are in the discharged state. Accordingly, a maximum value of the electric current consumed when the actuators are placed into the charged state can be lowered, thereby lowering the threshold used for the determination as to whether the electric power supply from the at least one power supply device is inhibited by the power-supply inhibiting portion, namely, as to the determination whether a short circuit is occurring. It is, therefore, possible to inspect the actuators and the signal output circuits for a short circuit without providing the electric current detecting device for each of the signal output circuits, ensuring a reduction in the size of the apparatus and a reduction in the cost of manufacture of the apparatus. Further, because the inrush current is suppressed, the load to be imposed on the at least one power supply device can be reduced and the unnecessary behavior of the actuators are inhibited for thereby preventing the ink from leaking from the nozzles.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE PREFERRED EMBODIMENT

There will be described one embodiment of the invention with reference to the drawings.

Figure 1:
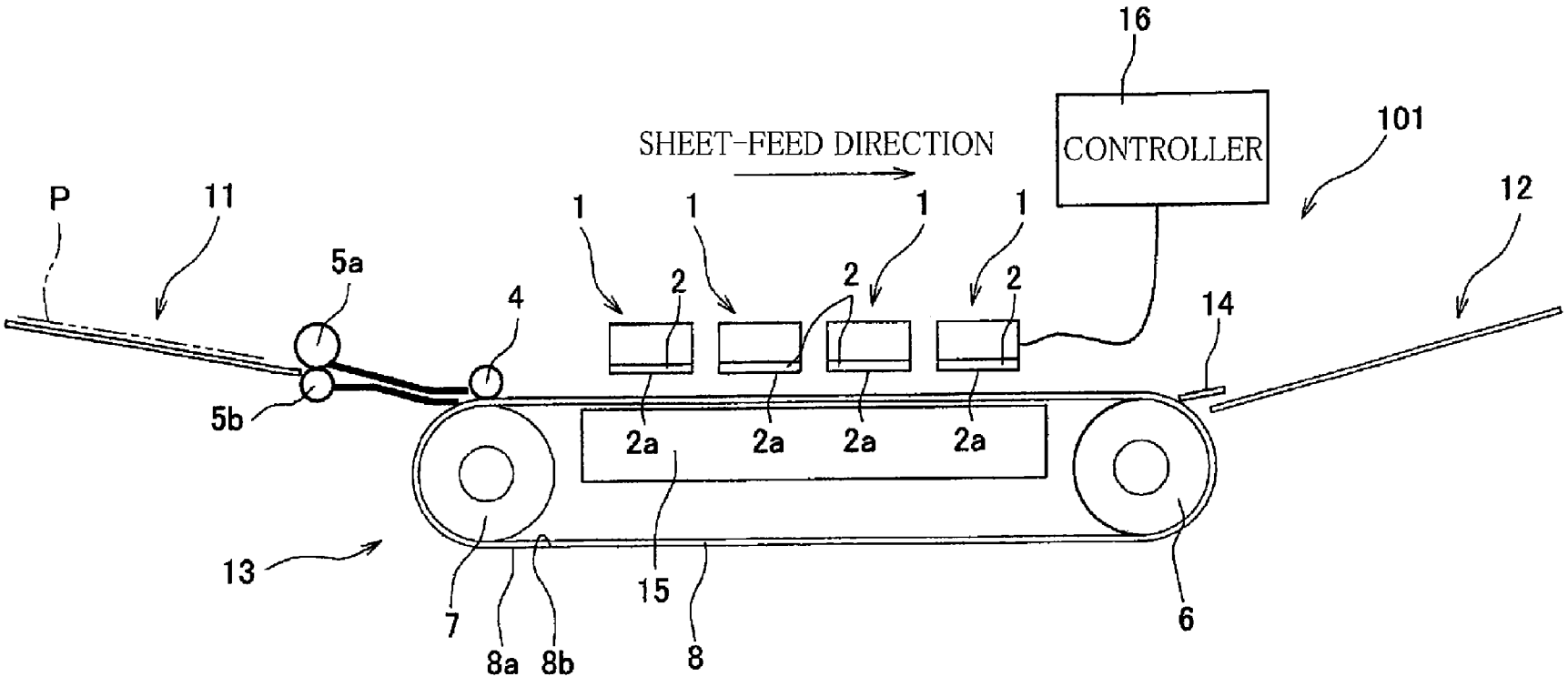
FIG. 1 is an external side view showing an ink-jet printer according to one embodiment of the present invention.

FIG. 1 is a schematic side elevational view showing an overall structure of an ink-jet printer as an ink-jet recording apparatus, according to one embodiment of the present invention. The ink-jet printer generally indicated at 101 in FIG. 1 is a color ink-jet printer having four ink-jet heads 1 and a controller 16 for controlling operations of the ink-jet printer 101. In the ink-jet printer 101, a sheet-supply portion 11 and a sheet-discharge portion 12 are disposed respectively at a left-side end portion and a right-side end portion in FIG. 1.

In the inside of the ink-jet printer 101, there is formed a sheet-feed path through which a sheet (as a recording medium) P is fed in a sheet-feed direction from the sheet-supply portion 11 toward the sheet-discharge portion 12. On a downstream side of the sheet-supply portion 11, there is disposed a pair of sheet-feed rollers 5*a*, 5*b* by which the sheet P is fed while being held therebetween. The sheet-feed rollers 5*a*, 5*b* feed the sheet toward a rightward direction in FIG. 1 from the sheet-supply portion 11. At a middle portion in the sheet-feed path, there is disposed a feed mechanism 13 that includes two belt rollers 6, 7, an endless feed belt 8 wound around the two belt rollers 6, 7 so as to be stretched therebetween, and a platen 15 disposed in a region enclosed by the feed belt 8. The platen 15 is for supporting, at a position where the platen 15 faces the ink-jet heads 1, the feed belt 8 such that the feed belt 8 does not deflect downward. Further, a nip roller 4 is disposed so as to face the belt roller 7 for pressing the sheet P fed from the sheet-supply portion 11 by the sheet-feed rollers 5*a*, 5*b*, toward an outer circumferential surface 8*a* of the feed belt 8.

The belt roller 6 is rotated by a feed motor (not shown) and the feed belt 8 is accordingly moved, so that the sheet P pressed by the nip roller 4 onto the outer circumferential surface 8*a* of the feed belt 8 is fed toward the sheet-discharge portion 12 while adhering to and being held by the feed belt 8. The feed belt 8 has a silicone resin layer with low adhesion property formed on the outer circumferential surface 8*a* thereof.

On the downstream side of the feed belt 8 in the sheet-feed direction, there is provided a sheet separation mechanism 14 configured to separate the sheet P adhering to the outer circumferential surface 8*a* of the feed belt 8 and to guide the sheet P toward the sheet-discharge portion 12 disposed at the right-side end portion in FIG. 1.

The four ink-jet heads 1 respectively correspond to inks of four colors, i.e., magenta, yellow, cyan, and black, and are arranged in the sheet-feed direction. Accordingly, the ink-jet printer 101 is of a line type. Each of the four ink-jet heads 1 has a head body 2 at a lower end thereof. The head body 2 is a rectangular parallelepiped having a larger length in a direction perpendicular to the sheet-feed direction. The head boy 2 has a bottom surface functioning as an ink ejection surface 2*a* that faces the outer circumferential surface 8*a* of the feed belt 8. When the sheet P fed on the feed belt 8 passes right below the four head bodies 2, ink droplets of the four colors are ejected from the ink ejection surfaces 2*a* of the respective four head bodies 2 toward the upper surface or print surface (print region) of the sheet P. Thus, a desired color image is formed on the print region of the sheet P.

Figure 2:
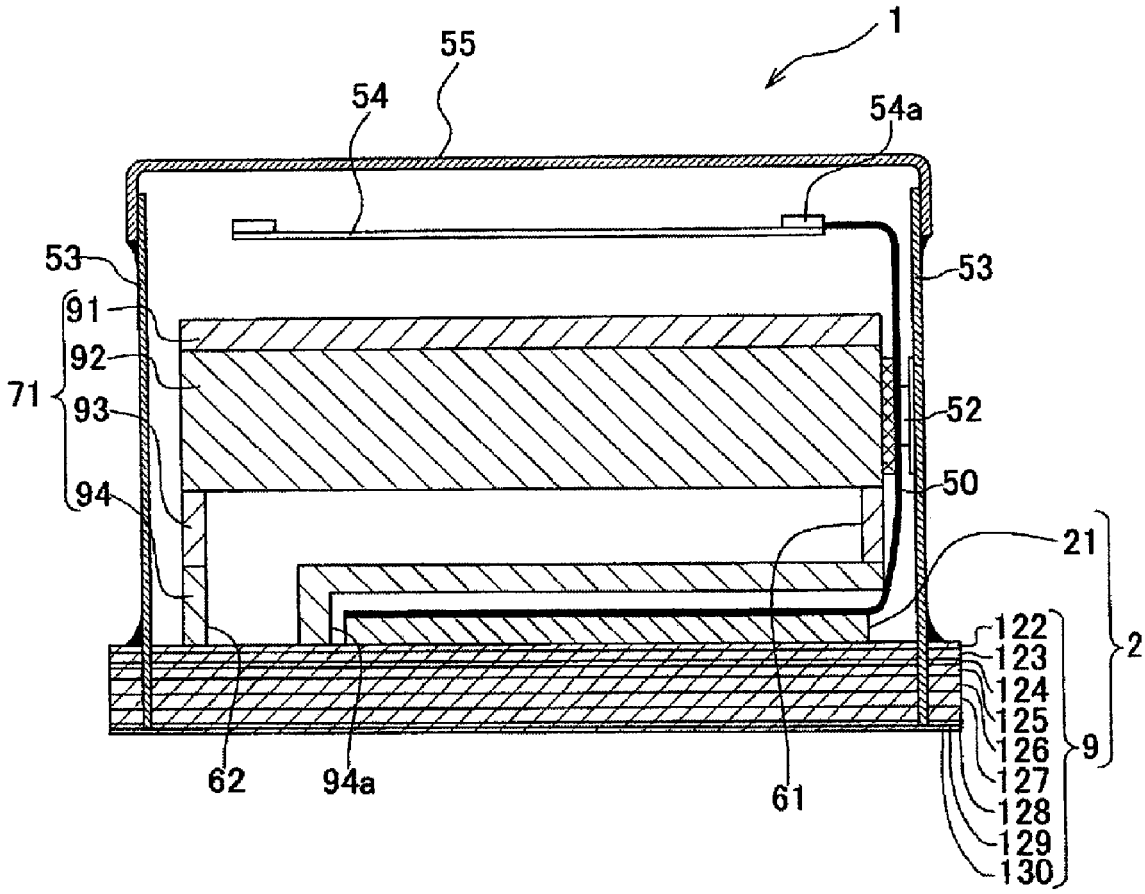
FIG. 2 is a cross sectional view showing an ink-jet head of the ink-jet printer of FIG. 1 taken along a width direction of the ink-jet head.

Referring next to FIG. 2, the ink-jet head 1 will be explained in detail. FIG. 2 is a cross sectional view of the ink-jet head 1 taken along the width direction of the same 1. As shown in FIG. 2, the ink-jet head 1 is constituted by a flow-passage section in which flow passages are formed, an electric-component section for permitting the ink droplets to be ejected from the flow-passage section, and a cover section for protecting the electric-component section. The flow-passage section includes: the head body 2 including a flow-passage unit 9 and actuator units 21; and a reservoir unit 71 disposed on the upper surface of the head body 2. The reservoir unit 71 temporarily stores the ink to be supplied to the head body 2. The electric-component section includes: a Chip On Film (COF) 50 on which driver ICs 52 are mounted; and a substrate 54 which is electrically connected to the COF 50. The COF 50 is connected at its one end to the actuator units 21, and a drive signal generated by each driver IC 52 is sent to the corresponding actuator unit 21. The cover section is constituted by side covers 53 and a top cover 55. The cover section accommodates the electric-component section therein for preventing entry of ink and mist of ink thereinto.

The reservoir unit 71 is formed by four plates 91-94 superposed on each other. In the reservoir unit 71, there are formed an ink inlet passage (not shown), an ink reservoir 61, and ten ink outlet passages 62, which are in communication with each other. In FIG. 2, only one of the ten ink outlet passages 62 is shown.

The plate 94 has a recessed portion 94*a* formed in its surface facing the flow-passage unit 9, so that a clearance is defined between the plate 94 and the flow-passage unit 9. The actuator unit 21 is disposed in the clearance. The ink flowed into the ink reservoir 61 passes through the ink outlet passages 62 and is supplied to the flow-passage unit 9 via respective ink supply holes 105*b* of the flow-passage unit 9.

The COF 50 is bonded, at the vicinity of its one end, to the upper surface of each actuator unit 21 for electrical connection with individual electrodes 135 and a common electrode 134 which will be explained. Further, the COF 50 is drawn upward from the upper surface of each actuator unit 21 so as to extend between one of the side covers 53 and the reservoir unit 71, and is connected, at the other end thereof, to the substrate 54 via a connector 54*a*. The substrate 54 is for relaying drive signals from the controller 16 to each driver IC 52.

Figure 3:
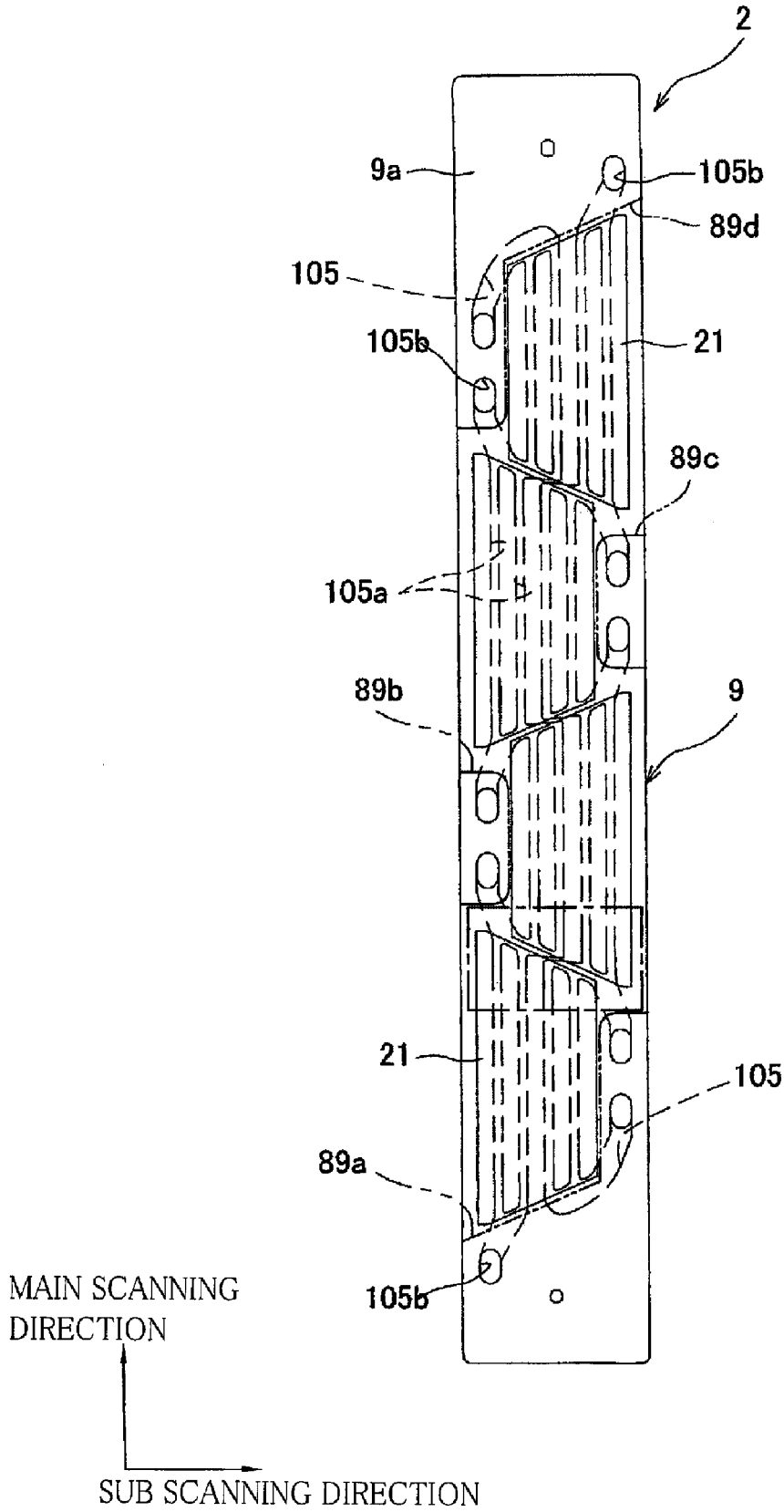
FIG. 3 is a plan view of a head body of the ink-jet head shown in FIG. 2.
Figure 4:
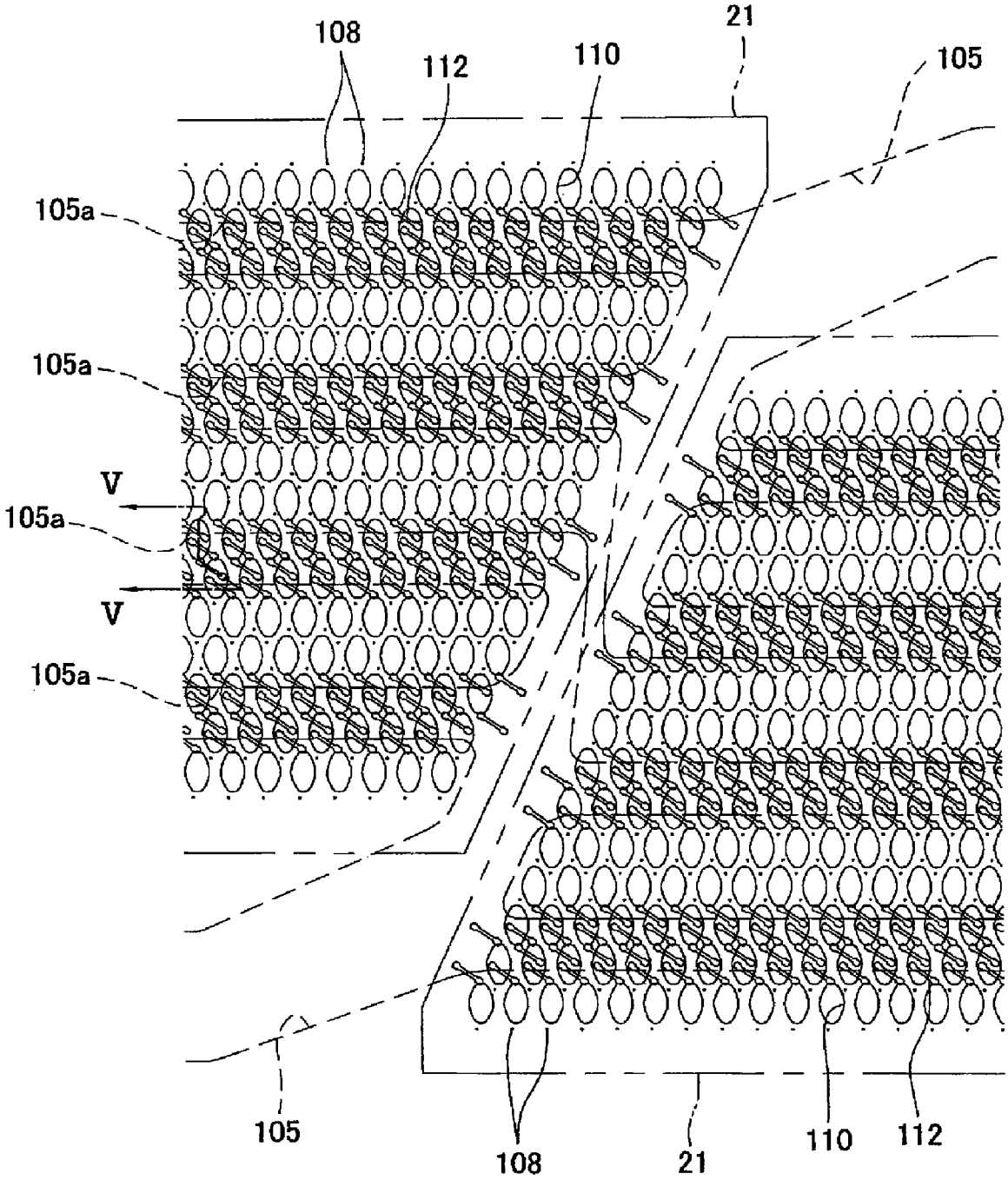
FIG. 4 is an enlarged view of a region enclosed by one-dot chain line in FIG. 3.
Figure 5:
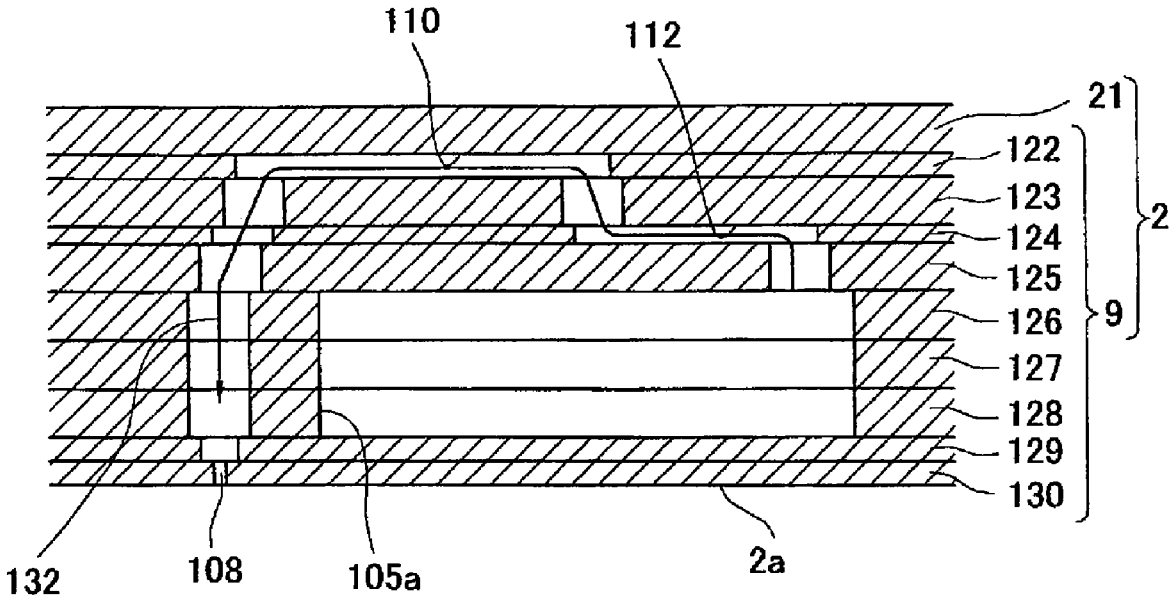
FIG. 5 is a cross sectional view taken along line V-V in FIG. 4.

Referring next to FIGS. 3-6, the head body 2 will be explained. FIG. 3 is a plan view of the head body 2 and FIG. 4 is an enlarged view of a region enclosed by one-dot chain line in FIG. 3. In FIG. 4, pressure chambers 110, apertures 112, and nozzles 108 located below the actuator units 21 are indicated by solid lines instead of broken lines for convenience sake. FIG. 5 is a partial cross sectional view taken along line V-V in FIG. 4. FIG. 6A is an enlarged cross sectional view of the actuator unit 21 and FIG. 6B is a plan view of the individual electrode 135 provided on the actuator unit 21.

As shown in FIG. 3, the head body 2 is constituted by the flow-passage unit 9 and the four actuator units 21 fixed on an upper surface 9*a* of the flow-passage unit 9. As shown in FIG. 4, each actuator unit 21 includes a plurality of actuators provided so as to face the respective pressure chambers 110 formed in the flow-passage unit 9 and has a function of selectively giving an ejection energy to the ink in the pressure chambers 110.

The flow-passage unit 9 is a rectangular parallelepiped having substantially the same shape in plan view as the plate 94 of the reservoir unit 71. The ten ink supply holes 105*b* are open to the upper surface 9*a* of the flow-passage unit 9 so as to respectively correspond to the ten ink outlet passages 62 (FIG. 2) of the reservoir unit 71. In the flow-passage unit 9, there are formed: manifolds 105 communicating with the corresponding ink supply holes 105*b*; and sub manifolds 105*a* branched from the corresponding manifolds 105. On a lower surface of the flow-passage unit 9, the ink ejection surface 2*a* is formed in which a multiplicity of the nozzles 108 are arranged in a matrix, as shown in FIGS. 4 and 5. Like the nozzles 108, the pressure chambers 110 are formed in a matrix on the upper surface 9*a* of the flow-passage unit 9 to which the actuator units 21 are fixed.

The flow-passage unit 9 is constituted by nine metal plates 122-130 each formed of stainless steel or the like and each having a rectangular shape in plan view that is elongate in a main scanning direction.

The plates 122-130 are superposed on each other while being aligned with each other, whereby through-holes formed in the respective plates 122-130 are connected to each other to form, in the flow-passage unit 9, a multiplicity of individual ink passages 132 extending from the manifolds 105 to the nozzles 108 via the sub manifolds 105*a* and the pressure chambers 110.

The ink supplied from the reservoir unit 71 into the flow-passage unit 9 flows into the individual ink passages 132 from the manifolds 105 (the sub manifolds 105*a*) and reaches the nozzles 108 via the apertures or orifices 112 and the pressure chambers 110.

The actuator unit 21 will be explained. As shown in FIG. 3, the four actuator units 21 have a trapezoidal shape in plan view and are arranged in a zigzag fashion so as not to overlap the ink supply holes 105*b*. Two parallel sides in each of the trapezoidal actuator units 21 extend in a longitudinal direction of the flow-passage unit 9 while two oblique sides of adjacent two actuator units 21 partially overlap each other with respect to the width direction of the flow-passage unit 9, namely, in a sub scanning direction.

Figure 6A:
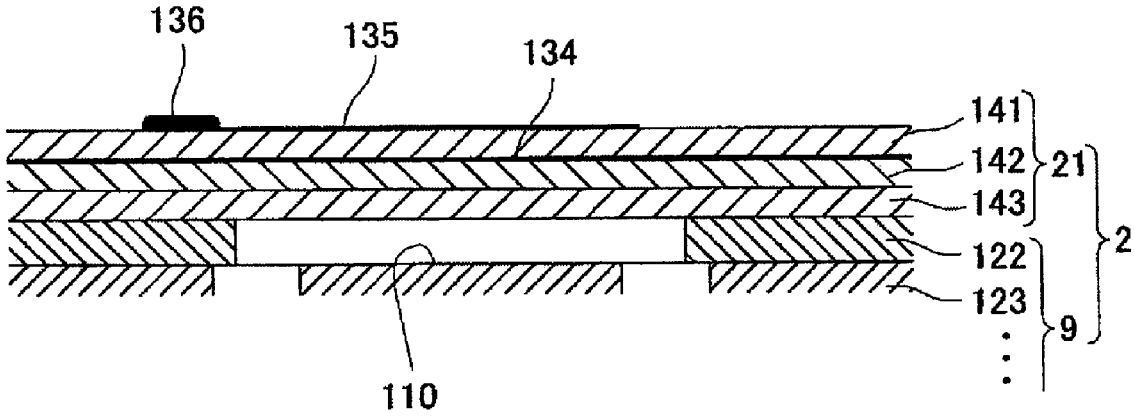
FIG. 6A is an enlarged cross sectional view of an actuator unit of FIG. 4
Figure 6B:
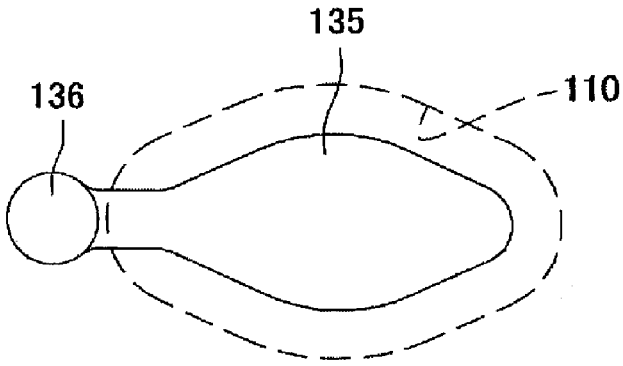
FIG. 6B is a plan view of an individual electrode disposed on a surface of the actuator unit.

As shown in FIG. 6A, each actuator unit 21 is constituted by three piezoelectric sheets or layers 141-143 each of which is formed of a ceramic material of lead zirconate titanate (PZT) having ferroelectricity. The individual electrodes 135 are formed at portions of the upper surface of the uppermost piezoelectric sheet 141 that correspond to the respective pressure chambers 110. The common electrode (ground electrode) 134 is interposed between the uppermost piezoelectric sheet 141 and the piezoelectric sheet 142 located under the sheet 141, so as to extend over entire surfaces of the sheets 141, 142. As shown in FIG. 6B, each individual electrode 135 has a generally rhombic shape in plan view similar to the pressure chambers 110. One acute end of the individual electrode 135 is extended, and a circular conductive land 136 is provided at the extended end.

Figure 8:
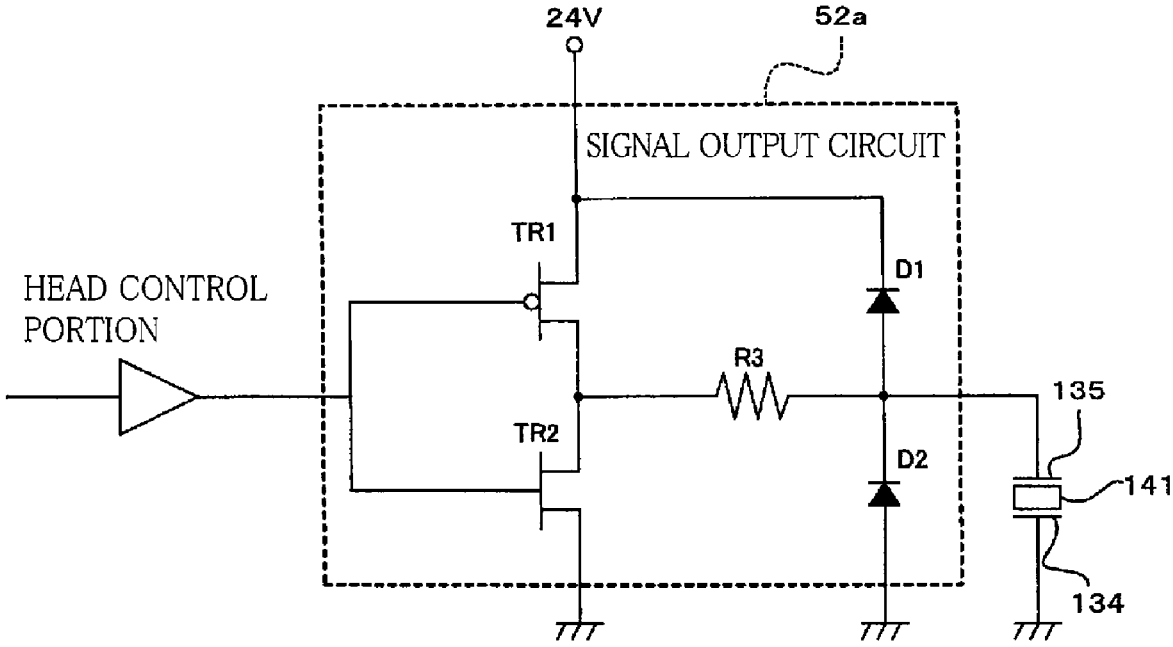
FIG. 8 is a circuit diagram of a signal output circuit of a driver IC shown in FIG. 2.

In each actuator unit 21, the common electrode 134 is given a ground potential (base potential). The individual electrodes 135 are electrically connected to respective signal output circuits 52*a* as shown in FIG. 8 provided in the driver IC 52, via the corresponding lands 136 and the internal wiring of the COF 50. In each actuator unit 21, a portion sandwiched by and between each individual electrode 135 and a corresponding one of the pressure chambers 110 functions as one actuator.

The manner of driving or activating the actuator unit 21 will be explained. The piezoelectric sheet 141 is sandwiched by and between the multiplicity of individual electrodes 135 and the common electrode 134 while the piezoelectric sheets 142, 143 are sandwiched by and between the common electrode 134 and the upper surface 9*a* of the flow-passage unit 9. A portion of the piezoelectric sheet 141 sandwiched by and between each individual electrode 135 and the common electrode 134 functions as an active layer which is configured to contract or expand in a direction parallel to the surface of the sheet 141 (hereinafter referred to as "surface direction") upon application of a voltage between the electrodes 135, 134. The portion functioning as the active layer deforms so as to change the volume of the corresponding pressure chamber 110, cooperating with the piezoelectric sheets 142, 143 that are nearer to the pressure chambers 110 than the sheet 141. Where the polarization direction of the active layer and the direction of the electric field are both in the thickness direction of the sheets 141-143, the active layer contracts in the surface direction, and a portion of the sheets 141-143 corresponding to the individual electrode 135 deforms convexly toward the corresponding pressure chamber 110 (i.e., unimorph deformation). Accordingly, a pressure (ejection energy) is given to the ink in the pressure chamber 110 and therefore a pressure wave is generated in the same 110. The generated pressure wave propagates from the pressure chamber 110 to the corresponding nozzle 108, so that the ink droplet is ejected from the nozzle 108.

In the present embodiment, each actuator is, in advance, kept in a charged state by applying a drive potential to the corresponding individual electrode 135, and the volume of the corresponding pressure chamber 110 is decreased. Each time when an ejection requirement is made, there is outputted from the driver IC 52 a drive signal for once placing the actuator into the discharged state by applying the ground potential to the corresponding individual electrode 135 and again placing the actuator into the charged state by again applying the drive potential to the corresponding individual electrode 135 at suitable timing. In this instance, at timing when the potential of the individual electrode 135 becomes equal to the ground potential, the pressure of the ink in the corresponding pressure chamber 110 decreases, namely, the volume of the pressure chamber 110 increases, so that the ink is sucked from the corresponding sub manifold 105*a* into the corresponding individual ink passage 132. Subsequently, at timing when the potential of the individual electrode 135 becomes again equal to the drive potential, the pressure in the pressure chamber 110 increases, namely, the volume of the pressure chamber 110 decreases, so that the ink droplet is ejected from the corresponding nozzle 108. That is, a pulse with a rectangular waveform is applied to the individual electrode 135. The width of the pulse is equal to an acoustic length AL which is a time length required for the pressure wave to propagate from the outlet of the sub manifold 105*a* to the leading end of the nozzle 108 through the pressure chamber 110. When the pressure of the ink in the pressure chamber 110 changes from the negative pressure state to the positive pressure state, the ink droplet can be ejected from the nozzle 108 by a strong pressure because the pressure generated upon the volume decrease is added. In the present embodiment, the drive potential is equal to 24V.

In the ink ejecting operation by the actuator unit 21, when the potential of the individual electrode 135 is changed from the ground potential to the drive potential (e.g., 24V) and vice versa, a transient current flows. When the potential of the individual electrode 135 is changed from the ground potential to the drive potential, the transient current is supplied by a control power supply device 85. When the potential of the individual electrode 135 is changed from the ground potential to the drive potential, the charging current flows to the individual electrode 135. When the potential of the individual electrode 135 is changed from the drive potential to the ground potential, the discharging current flows from the individual electrode 135. Where there are no deficiencies in the actuator units 21 and the driver ICs 52 (the signal output circuits 52*a*), a prescribed transient current flows each time when the potential of the individual electrode 135 changes. In the present embodiment, the transient current flows for about 1 μsec immediately after the voltage transition.

Figure 7:
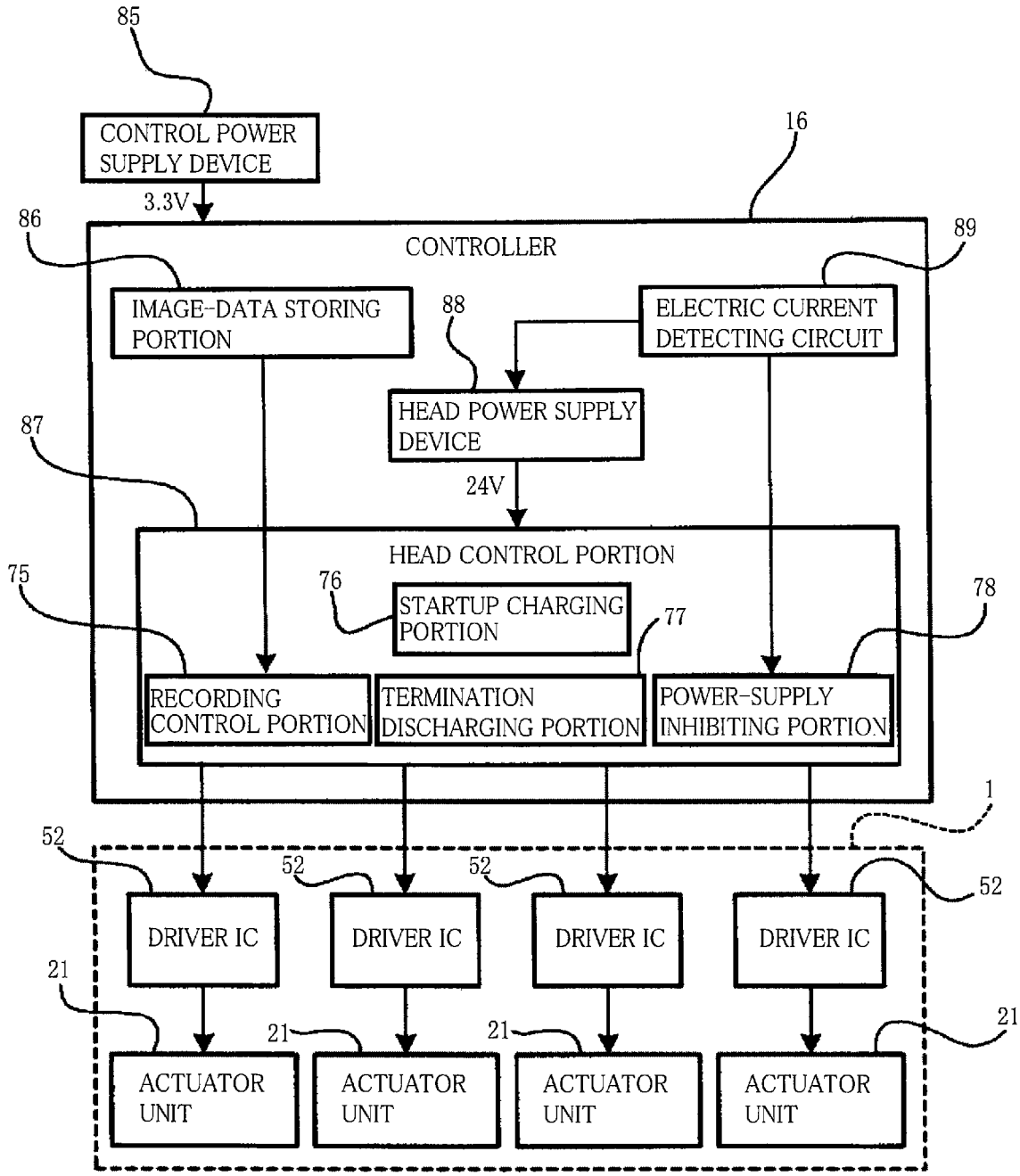
FIG. 7 is a functional block diagram of a controller shown in FIG. 1.

Referring next to the functional block diagram of FIG. 7, the controller 16 will be explained. As shown in FIG. 7, the controller 16 includes: an image-data storing portion 86; a head control portion 87 as a control device; a head power supply device 88 as a power supply device; and an electric current detecting circuit 89 as an electric current detecting device. The head control portion 87, the head power supply device 88, and the electric current detecting circuit 89 are provided on each of the four ink-jet heads 1. In FIG. 7, there are shown only one ink-jet head 1, and the head control portion 87, the head power supply device 88 and the electric current detecting device 89 which are connected to the above-indicated one ink-jet head 1. The controller 16 works by an electric power of 3.3V system supplied thereto from the control power supply device 85.

The image-data storing portion 86 stores image data of an image to be printed on the sheet P. The image data includes dot data of each of dots of the image to be printed. In the present embodiment, the dot data is constituted such that the volume of the ink droplet to be ejected from each nozzle 108 is represented in four tones.

The head control portion 87 controls activation of the actuator units 21 and includes a recording control portion 75, a startup charging portion 76, a termination discharging portion 77, and a power-supply inhibiting portion 78. The recording control portion 75 controls activation of each actuator unit 21 via the corresponding driver IC 52 such that the ink droplets are ejected from the nozzles 108 at desired timing according to the image data stored in the image-data storing portion 86. Each driver IC 52 includes a plurality of signal output circuits 52*a* for driving or activating respective actuators which are formed in the corresponding actuator unit 21 and which correspond to the respective nozzles 108. Hereinafter, each actuator is referred to as "a channel" where appropriate.

Referring next to the circuit diagram of FIG. 8, the operation of each signal output circuit 52*a* of the driver IC 52 will be explained. As shown in FIG. 8, the signal output circuit 52*a* includes: a p-channel transistor (MOS FET) TR1; an n-channel transistor (MOS FET) TR2; protective diodes D1, D2 each of which is disposed between a drain and a source of a corresponding one of the transistor TR1 and the transistor TR2; and a drive resistor R3. The drain of the transistor TR1 and the source of the transistor TR2 are connected. The output terminal of the head control portion 87 is connected to gates of the respective transistors TR1, TR2, and a control signal from the head control portion 87 is inputted to the transistors TR1, TR2. The drive resistor R3 is disposed between the individual electrode 135 and a connection of the two transistors TR1, TR2. The electric current value to be supplied to the individual electrode 135 is determined by the drive resistor R3. Where the control signal is at a Low level, the transistor TR1 turns on while the transistor TR2 turns off. In this state, the potential of 24V is given to the individual electrode 135 via the drive resistor R3, whereby the corresponding channel is charged. Where the control signal is at a High level, on the other hand, the transistor TR1 turns off while the transistor TR2 turns on. In this state, the ground potential is given to the individual electrode 135 via the drive resistor R3, whereby the corresponding channel is discharged. Thus, the signal output circuit 52*a* is an inverter circuit configured to give, to the corresponding individual electrode 135, drive signals of 24V system logically inverted with respect to the control signal of 3.3V system from the head control portion 87.

When the control signal from the head control portion 87 changes from the High level to the Low level or vice versa, both of the transistors TR1, TR2 simultaneously turn on for a moment, and a through current flows through the both of the transistors TR1, TR2. To prevent the through current, a through-current preventive circuit that adjusts the transition timing of the signal level may be provided between the head control portion 87 and the gates of the respective transistors TR1, TR2.

Referring back to FIG. 7, the startup charging portion 76 is for controlling charging and discharging of all actuator units 21 of the ink-jet head 1 upon startup of the ink-jet printer 101. Described more specifically, upon startup of the ink-jet printer 101, after the controller 16 has been operated by the electric power of 3.3V system supplied from the control power supply device 85, the start-up charging portion 76 outputs the control signal at the High level to the gates of the transistors TR1, TR2 of the signal output circuits 52*a* corresponding to all of the channels of all of the actuator units 21. In this state, the head power supply device 88 is allowed to output the electric power of 24V system. Accordingly, the signal for giving the ground potential to each individual electrode 135 is outputted from each of the signal output circuits 52*a* of each driver IC 52, and all of the channels of all of the actuator units 21 are placed into the discharging state. Thereafter, for placing the actuator units 21 into the charged state from the discharged state in order one by one, the startup charging portion 76 controls each of the signal output circuits 52*a* of the corresponding driver IC 52 to output the signal for giving the drive potential to each individual electrode 135. As a result, all of the channels of the all of the actuator units 21 are placed into the charged state, and the ink-jet printer 101 is placed into a standby mode.

The termination discharging portion 77 is for controlling charging and discharging of all actuator units 21 of the ink-jet head 1 upon terminating processing (termination) of the ink-jet printer 101. More specifically explained, at the time of initiation of the termination processing, all of the channels of all of the actuator units 21 are kept placed in the charged state. Accordingly, on the precondition that all of the channels of all of the actuator units 21 are in the charged state upon initiation of the termination processing, the termination discharging portion 77 controls each of the signal output circuits 52 of each driver IC 52 to output the signal for giving the drive potential to each individual electrode 135. When all of the channels of all of the actuator units 21 are in the charged state, for placing the actuator units 21 into the discharged state from the charged state in order one by one, the termination discharging portion 77 controls each of the signal output circuits 52*a* of the corresponding driver IC 52 to output the signal for giving the ground potential to each individual electrode 135. More specifically explained, for placing the channels in each actuator unit 21 into the discharged state from the charged state in order one channel by one channel, the termination discharging portion 77 controls each of the signal output circuits 52*a* of the corresponding driver IC 52 to output the signal for giving the ground potential to each individual electrode 135. Thereafter, the electric power supply of 24V system from the head power supply device 88 is stopped. Where the ink-jet printer 101 is configured such that the ink-jet printer 101 is kept in the standby mode with the channels of each actuator unit 21 placed in the discharged state, the termination discharging portion 77 may be configured to control, in the control for charging and discharging of the actuator units 21, the signal output circuits 52*a* such that all channels are once placed into the charged state upon initiation of the terminating processing.

The head power supply device 88 is a 24V-system power source for driving the actuator units 21. The electric power of 24V system outputted from the head power supply device 88 is supplied to the driver ICs 52 via the head control portion 87. The electric current detecting circuit 89 is for detecting an electric current at the output portion of the head power supply device 88. The result of detection by the detecting circuit 89 is sent to the power-supply inhibiting portion 78 of the head control portion 87.

The electric current detecting circuit 89 detects the electric current except for a time period during which the transient current flows. The electric current detecting circuit 89 starts to detect the electric current in 1 μsec or longer after the potential transition. Accordingly, the electric current detected upon charging by the startup charging portion or upon discharging by the termination discharging portion 77 does not include the transient current.

When the startup charging portion 76 is performing the charging of the channels of each actuator unit 21 or when the termination discharging portion 77 is performing the discharging of the channels of each actuator unit 21, the power-supply inhibiting portion 78 inhibits or stops the electric power of the 24V system from outputting from the head power supply device 88 where the electric current detecting circuit 89 detects an overcurrent, namely, an electric current equal to or larger than a prescribed threshold. By inhibiting the electric power supply of 24V system from the head power supply device 88, the output of the drive signal from each signal output circuit 52*a* is stopped.

Figure 9:
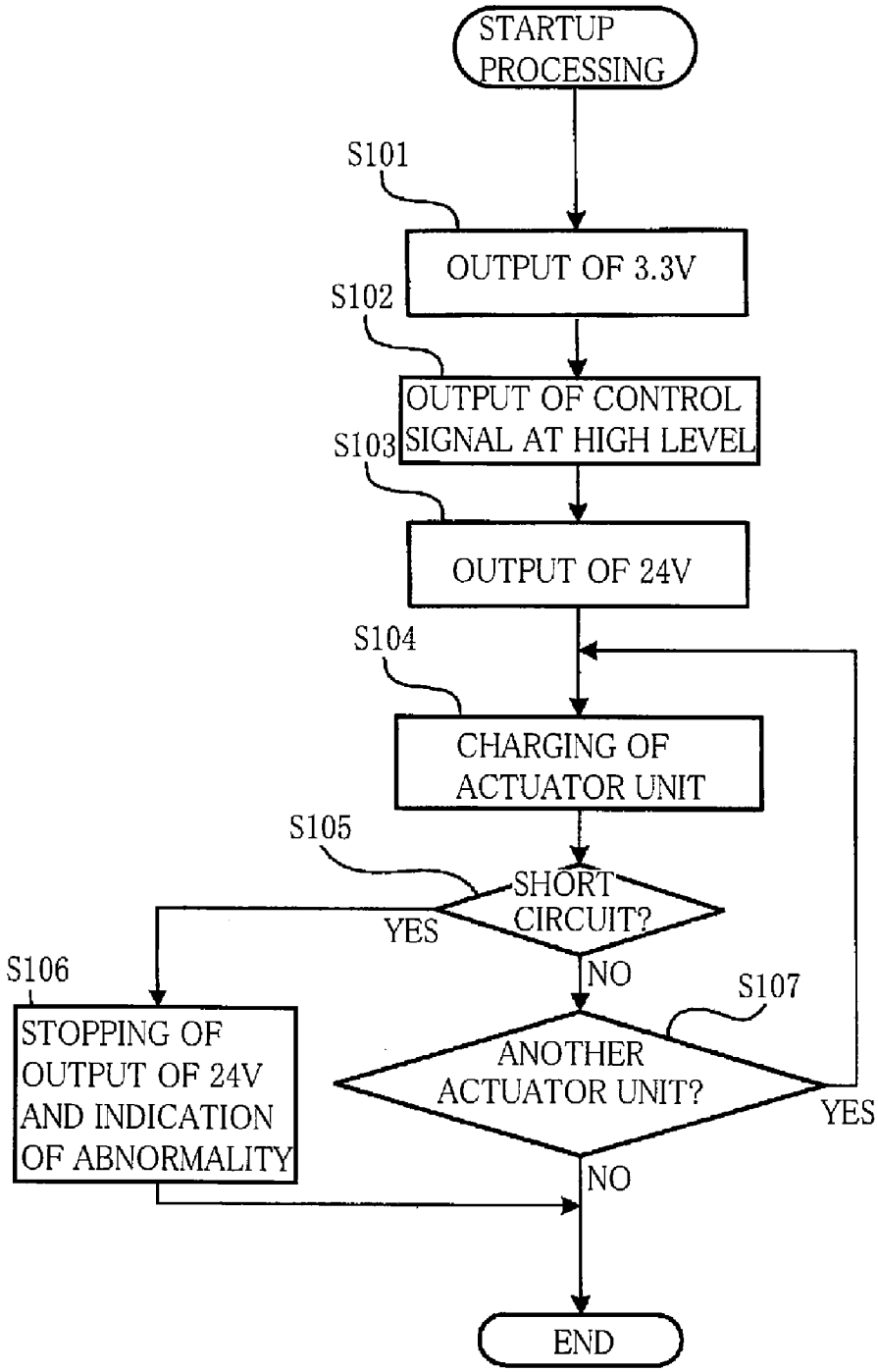
FIG. 9 is a flow chart showing a procedure of startup processing upon startup of the ink-jet printer of FIG. 1.

Referring next to FIG. 9, there will be explained startup processing upon startup of the ink-jet printer 101. FIG. 9 is a flow chart showing a procedure of the startup processing for the ink-jet printer 101. When a startup command for starting the ink-jet printer 101 is inputted by a user, step S101 (hereinafter "step" is omitted where appropriate) is implemented to permit the control power supply device 85 to output the electric power of 3.3V system, so that the controller 16 is operated. S101 is followed by S102 in which the startup charging portion 76 outputs the control signal at the High level to the gates of the respective transistors TR1, TR2 of the signal output circuits 52*a* corresponding to all channels of all actuator units 21.

S102 is followed by S103 in which the head power supply device 88 outputs the electric power of 24V system. Because the control signal at High level has been inputted to the gates of the respective transistors TR1, TR2 of each of the signal output circuits 52*a*, each of the signal output circuits 52*a* of each driver IC 52 outputs the drive signal for giving the ground potential to the corresponding individual electrode 135. As a result, all of the channels of all of the actuator units 21 are placed into the discharged state.

Thereafter, S104 is implemented in which, for placing all channels of one of the actuator units 21 into the charged state from the discharged state, the startup charging portion 76 controls each of the signal output circuits 52*a* of the corresponding driver IC 52 to output the drive signal for giving the drive potential to the corresponding individual electrode 135. S104 is followed by S105 to judge whether the electric current detecting circuit 89 has detected an overcurrent (short circuit). Where the short circuit is occurring between the individual electrode 135 and the common electrode 134 in one of the channels, for instance, the electric current flows in the signal output circuit 52*a* corresponding to that one channel via the shorted portion even after that channel has been placed into the charged state. In consequence, the electric current detecting circuit 89 detects an abnormal overcurrent. As a modification of the present embodiment, the drive signal for giving the drive potential to the individual electrode 135 may be outputted from each of the signal output circuits 52*a* of each driver IC 52 for placing the channels in the corresponding actuator unit 21 into the charged state from the discharged state in order one channel by one channel. In this instance, it is possible to detect a short circuit that is occurring between the two individual electrodes 135 of adjacent two channels, for instance. More specifically explained, when one of the two adjacent channels is kept in the charged state while the other is placed into the discharged state, the electric current flows from the signal output circuit 52*a* corresponding to the channel in the charged state to the signal output circuit 52*a* corresponding to the channel in the discharged state via the shorted portion. In such an instance, too, the electric current detecting circuit 89 detects an abnormal overcurrent.

Where it is judged in S105 that the electric current detecting circuit 89 has detected an overcurrent (S105: YES), S106 is implemented in which the power-supply inhibiting portion 78 inhibits or stops the electric power of 24V system from being outputted from the head power supply device 88, and the occurrence of abnormality is indicated on a display not shown. Thus, one execution of the routine of the flow chart of FIG. 9 is ended. On the other hand, where it is judged in S105 that the electric current detecting circuit 89 has not detected any overcurrent (S105: NO), S107 is implemented in which the startup charging portion 76 judges whether there exists another actuator unit 21 to be subsequently placed into the charged state. Where the startup charging portion 76 judges that there exists another actuator unit 21 to be subsequently placed into the charged state (S107: YES), the control flow goes back to S104 and the above-indicated processing is repeated. On the other hand, where the startup charging portion 76 judges that there exists no actuator unit 21 to be subsequently placed into the charged state (S107: NO), one execution of the routine of the flow chart of FIG. 9 is ended. When the startup processing by the startup charging portion 76 is completed, all of the channels of all of the actuator units 21 are kept in the charged state, so that the channels can be quickly driven for ejection of the ink droplets.

Figure 10:
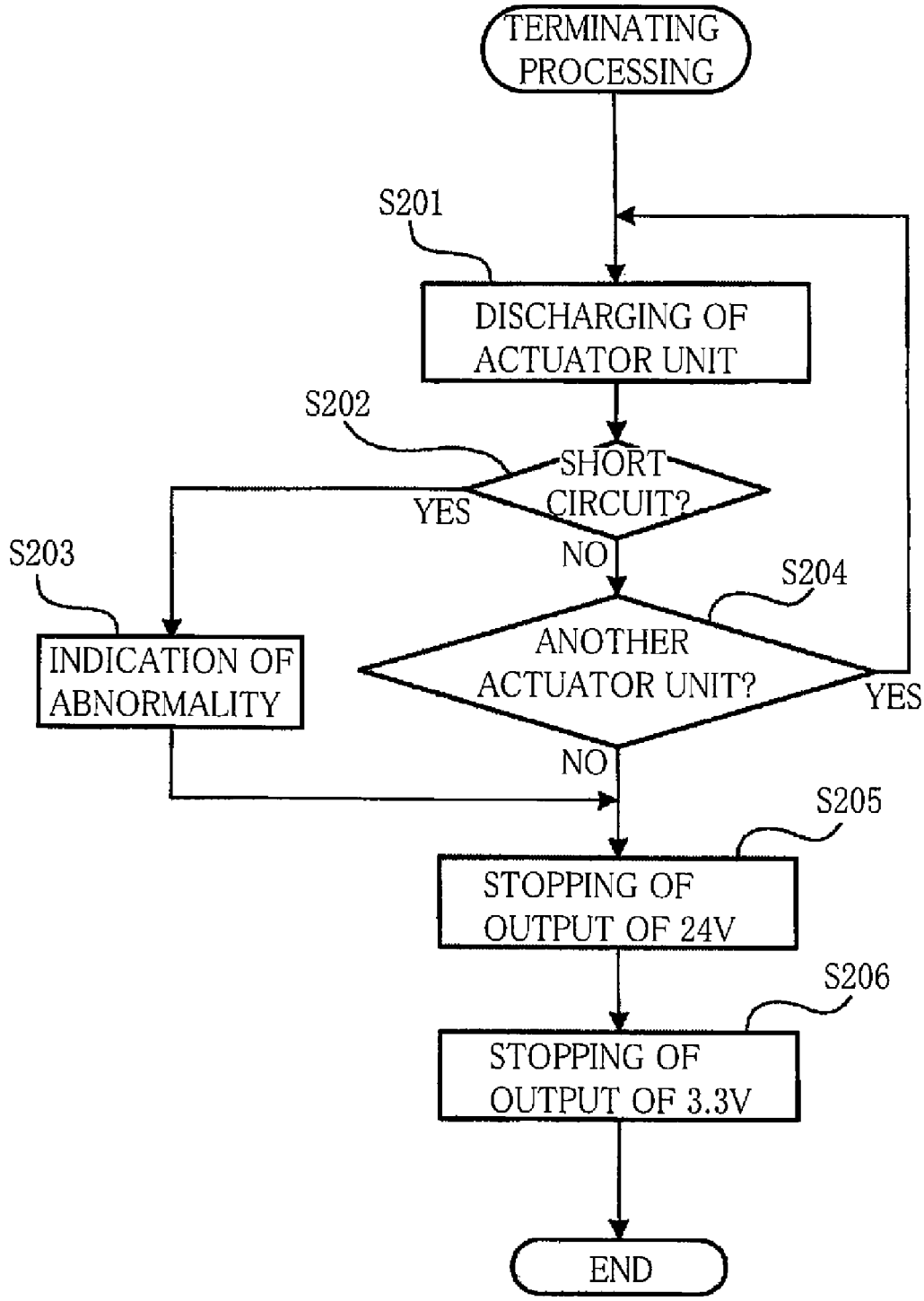
FIG. 10 is a flow chart showing a procedure of termination processing upon terminating processing of the ink-jet printer of FIG. 1.

Referring next to FIG. 10, there will be explained terminating processing upon termination of the ink-jet printer 101. FIG. 10 is a flow chart showing a procedure of the terminating processing for the ink-jet printer 101. It is noted that all of the channels of all of the actuator units 21 are kept placed in the charged state when the ink-jet printer 101 is in the standby mode for printing. In this state, when a termination command for terminating the ink-jet printer 101 is inputted by the user, step S201 is implemented in which, for placing the channels of one of the actuator units 21 into the discharged state from the charged state in order one channel by one channel, the termination discharging portion 77 controls each of the signal output circuits 52*a* of the corresponding driver IC 52 to output the drive signal for giving the ground potential to the corresponding individual electrode 135. As explained above, when one of the two adjacent channels is kept in the charged state while the other is placed into the discharged state in an instance where the short circuit is occurring between the two individual electrodes 135 of the adjacent two channels, the electric current flows from the signal output circuit 52*a* corresponding to the channel in the charged state to the signal output circuit 52*a* corresponding to the channel in the discharged state via the shorted portion, so that the electric current detecting circuit 89 detects an abnormal overcurrent.

S201 is followed by S202 in which it is judged whether the electric current detecting circuit 89 has detected an overcurrent (short circuit). Where it is judged in S201 that the electric current detecting circuit 89 has detected an overcurrent (S202: YES), S203 is implemented in which the occurrence of abnormality is indicated on the display. The control flow then goes to S205 in which the power-supply inhibiting portion 78 inhibits or stops the output of the electric power of 24V system from the head power supply device 88 and subsequently to S206 in which the termination discharging portion 77 stops the output of the electric power of 3.3V system from the control power supply device 85. On the other hand, where it is judged in S202 that the electric current detecting circuit 89 has not detected any overcurrent (S202: NO), S204 is implemented in which the termination discharging portion 77 judges whether there exists another actuator unit 21 to be subsequently placed into the discharged state. Where the termination discharging portion 77 judges that there exists another actuator unit 21 to be subsequently placed into the charged state (S204: YES), the control flow goes back to S201 and the above-indicated processing is repeated. On the other hand, where the termination discharging portion 77 judges that there exists no actuator unit 21 to be subsequently placed into the discharged state (S204: NO), S205 is implemented in which the power-supply inhibiting portion 78 inhibits or stops the output of the electric power of 24V from the head power supply device 88. S205 is followed by S206 in which the termination discharging portion 77 stops the output of the electric power of 3.3V system from the control power supply device 85. Thus, the ink-jet printer 101 is terminated and one execution of the routine of the flow chart of FIG. 10 is ended.

In the illustrated embodiment, the startup charging portion 76 places, upon startup of the ink-jet printer 101, the channels in each of the actuator units 21 into the charged state from the discharged state, in order one actuator unit by one actuator unit. Accordingly, the inrush current upon charging of the actuators is small, whereby the electric current can be detected with high stability. Further, the electric current that flows when the short circuit occurs can be suppressed, ensuring accurate measurement of the electric current and reliable judgment as to whether the short circuit is occurring or not. Moreover, the maximum value of the electric current consumed upon charging is lowered, thereby lowering the threshold used for the determination as to whether the electric power supply from the head power supply device 88 is inhibited by the power-supply inhibiting portion 78, namely, the determination as to whether the short circuit is occurring or not. It is, therefore, possible to inspect the actuator units 21 and the signal output circuits 52*a* for the short circuit, without providing the electric current detecting device for each of the signal output circuits 52*a*, ensuring a reduction in the size of the ink-jet printer 101 and a reduction in the cost of manufacture of the same 101. Further, because the inrush current (the transient current) can be suppressed, the load to be imposed on the head power supply device 88 can be reduced and the unnecessary behavior of the channels are inhibited for thereby preventing the ink leakage from the nozzles.

In the illustrated embodiment, the termination discharging portion 77 places, upon termination of the ink-jet printer 101, each of the channels in each of the actuator units 21 into the discharged state from the charged state, in order one channel by one channel in each actuator unit 21. It is, therefore, possible to inspect the actuator units 21 and the signal output circuits 52*a* for the short circuit even upon termination of the ink-jet printer 101. Accordingly, when the short circuit is detected, appropriate measures can be taken before next startup of the ink-jet printer 101.

In the illustrated embodiment, the head power supply device 88 is provided for each of the four ink-jet heads 1. Accordingly, the maximum value of the electric current consumed upon startup of the ink-jet printer 101 can be further lowered, and the inrush current can be suppressed with higher reliability.

In the illustrated embodiment, the plurality of actuators are unified to form one actuator unit 21, and the plurality of signal output circuits 52*a* corresponding to the plurality of actuators in one actuator unit 21 are included in one driver IC 52. Each of the four ink-jet heads 1 includes the plurality of actuator units and the plurality of driver ICs 52 that correspond respectively to the actuator units 21. Further, one head power supply device 88 is configured to supply the electric power to the signal output circuits 52*a* of each of the driver ICs 52 in one ink-jet head 1. Because the number of the head power supply device 88 provided in one ink-jet head 1 is less than the number of the driver ICs 52 in one ink-jet head 1, it is not necessary to provide the power supply device 88 and the electric current detecting circuit 89 individually for the respective driver ICs 52. Accordingly, it is possible to identify a defective driver IC or ICs 52 by the electric current detecting circuit 89 whose number is smaller than that of the driver ICs 52, contributing to a reduced cost of manufacture of the ink-jet printer 101.

While the preferred embodiment of the invention has been described by reference to the accompanying drawings, for illustrative purpose only, it is to be understood that the present invention is not limited to the details of the illustrated embodiment, but may be embodied with various changes and modifications, which may occur to those skilled in the art, without departing from the spirit and scope of the invention defined in the attached claims.

As described above, in the illustrated embodiment, the startup charging portion 76 places, upon startup of the ink-jet printer 101, the channels in each of the actuator units 21 into the charged state from the discharged state, in order one actuator unit by one actuator unit. The number of a set of the channels to be placed into the charged state is not limited to the number of the channels in each actuator unit 21, but may be arbitrarily determined. For instance, the number of a set of the channels to be placed into the charged state may be equal to a number of the nozzles in one nozzle row formed in the ink ejection surface 2*a* or a total number of the nozzles in a plurality of nozzle rows for one sub manifold 105*a*. Alternatively, the channels may be placed into the charged state one by one. In this instance, it is possible to find or identify a defective channel with high reliability.

As described above, in the illustrated embodiment, the termination discharging portion 77 places, upon termination of the ink-jet printer 101, each of the channels in each of the actuator units 21 into the discharged state from the charged state, in order one channel by one channel in each actuator unit 21. The number of a set of the channels to be placed into the discharged state is not limited to the number of the channels in each actuator unit 21, but may be arbitrarily determined. For instance, the number of a set of the channels to be placed into the discharged state may be equal to the number of the nozzles in one nozzle row formed in the ink ejection surface 2*a* or the total number of the nozzles in a plurality of nozzle rows for one sub manifold 105*a*. In the illustrated embodiment, the channels in each actuator unit 21 is placed into the discharged state one by one. In this instance, it is possible to find or identify a defective channel with high reliability. In this respect, the controller 16 may be configured such that the controller 16 does not have the termination discharging portion 77 and such that all of the channels are simultaneously placed into the discharged state from the charged state upon termination of the ink-jet printer 101.

In the illustrated embodiment, the control by the startup charging portion 76 and the control by the termination discharging portion 77 are executed for each of the actuator units 21, for detecting the electric current. Those controls may be executed for each of the driver ICs 52. In this instance, even where one driver IC 52 outputs the drive signals to a plurality of actuator units 21, it is possible to quickly confirm the presence or absence of any deficiency without obtaining the result of detection of the electric current and the judgment based on the detection result in the corresponding actuator units 21.

In the illustrated embodiment, the head power supply device 88 is provided for each of the four ink-jet heads 1. The head power supply device 88 may be provided for each of groups of ink-jet heads 1.

What is claimed is:

1. An ink jet recording apparatus, comprising:

a flow-passage unit including a plurality of pressure chambers, a plurality of nozzles provided so as to respectively correspond to the plurality of pressure chambers, and a plurality of individual ink passages through which the plurality of pressure chambers respectively communicate with the plurality of nozzles;

a plurality of actuators including a plurality of individual electrodes provided so as to respectively correspond to the plurality of pressure chambers, a ground electrode which is disposed so as to face to the plurality of individual electrodes and to which is given a base potential, and a piezoelectric layer interposed between the plurality of individual electrodes and the ground electrode;

a plurality of signal output circuits which are provided so as to respectively correspond to the plurality of actuators and each of which outputs a signal for giving a drive potential to a corresponding one of the plurality of individual electrodes for placing a corresponding one of the plurality of actuators into a charged state and each of which outputs a signal for giving the base potential to the corresponding one of the plurality of individual electrodes for placing the corresponding one of the plurality of actuators into a discharged state;

at least one power supply device which supplies, to the plurality of signal output circuits, an electric power for giving the drive potential to the plurality of individual electrodes;

at least one electric current detecting device which detects an electric current with respect to the electric power supplied by the at least one power supply device; and a control device including (a) a startup charging portion which controls the plurality of signal output circuits, upon startup of the ink-jet recording apparatus, such that all of the plurality of actuators are placed into the charged state from the discharged state in order at least one by one, when all of the plurality of actuators are in the discharged state and a termination discharging portion which controls, when an operation of the ink jet recording apparatus terminates, the plurality of signal output circuits, such that the plurality of actuators are placed into the discharged state from the charged state in order one by one, when all of the plurality of actuator units are in the charged state and (b) a power-supply inhibiting portion which inhibits the electric power from being supplied from the at least one power supply device when the electric current detected by any of the at least one electric current detecting device is equal to or larger than a threshold during execution of a control by the startup charging portion and during execution of a control by the termination discharging portion.

2. The ink jet recording apparatus according to claim 1, wherein the startup charging portion is configured to control the plurality of signal output circuits such that the plurality of actuators are placed into the charged state from the discharged state in order at least one by one, after all of the plurality of actuators have been placed into the discharged state.

3. The ink jet recording apparatus according to claim 1, comprising one power supply device as the at least one power supply device and one electric current detecting device as the at least one electric current detecting device.

4. The ink jet recording apparatus according to claim 1, wherein each of the plurality of actuators is configured such that a portion interposed between a corresponding one of the plurality of individual electrodes and the ground electrode is deformed such that a volume of a corresponding one of the plurality of pressure chambers is smaller when said each of the plurality of actuators is in the charged state than when said each of the plurality of actuators is in the discharged state.

5. The ink jet recording apparatus according to claim 1, wherein the control device further includes a recording control portion which controls, when the ink-jet recording apparatus performs recording, the plurality of signal outputting circuits such that selected ones of the plurality of actuators are once placed into the discharged state from the charged state and thereafter placed again into the charged state at a prescribed timing.

6. The ink jet recording apparatus according to claim 1, further comprising at least one driver IC in each of which at least a part of the plurality of signal output circuits is included.

7. The ink jet recording apparatus according to claim 6, comprising, as the at least one drive IC, a plurality of driver ICs each of which includes a part of the plurality of signal output circuits that corresponds to a part of the plurality of actuators, wherein a number of the at least one power supply device is less than a number of the plurality of driver ICs.

8. The ink-jet recording apparatus according to claim 6, comprising at least one actuator unit in each of which at least a part of the plurality of actuators is unified.

9. The ink-jet recording apparatus according to claim 8, comprising:

a plurality of actuator units, as the at least one actuator unit, in each of which a part of the plurality of actuators is unified; and a plurality of driver ICs, as the at least one driver IC, which are provided so as to respectively correspond to the plurality of actuator units and each of which includes a part of the plurality of signal output circuits that corresponds to a part of the plurality of actuators included in a corresponding one of the plurality of actuator units.

10. The ink-jet recording apparatus according to claim 8, comprising an ink-jet head in which are integrated the at least one actuator unit and the at least one driver IC.

11. The ink-jet recording apparatus according to claim 10, comprising a plurality of ink-jet heads each as the ink-jet head.

* * * * *